US009252515B2

(12) United States Patent
Komoto et al.

(10) Patent No.: US 9,252,515 B2
(45) Date of Patent: Feb. 2, 2016

(54) THIN CONNECTOR

(71) Applicant: Japan Aviation Electronics Industry, Limited, Tokyo (JP)

(72) Inventors: Tetsuya Komoto, Tokyo (JP); Osamu Hashiguchi, Tokyo (JP); Yu Tatebe, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/605,469

(22) Filed: Jan. 26, 2015

(65) Prior Publication Data

US 2015/0280338 A1 Oct. 1, 2015

(30) Foreign Application Priority Data

Mar. 26, 2014 (JP) ..... 2014-063284

(51) Int. Cl.
*H01R 4/50* (2006.01)
*H01R 12/71* (2011.01)
*H01R 12/89* (2011.01)

(52) U.S. Cl.
CPC ..... *H01R 12/716* (2013.01); *H01R 12/89* (2013.01)

(58) Field of Classification Search
CPC ..... H01R 13/193
USPC ..... 439/342, 376
See application file for complete search history.

(56) References Cited

U.S. PATENT DOCUMENTS 3,907,394 A * 9/1975 Barnes ..... H05K 7/1023 439/342
5,989,049 A * 11/1999 Walkup ..... H01R 13/193 439/259
6,099,321 A * 8/2000 McHugh ..... H01R 13/193 439/342
6,159,032 A * 12/2000 McHugh ..... H01R 12/89 439/342
8,342,890 B2 * 1/2013 Zhu ..... H01R 12/716 439/682
8,513,523 B2 * 8/2013 Ambo ..... H01R 12/57 174/260
8,632,345 B2 * 1/2014 Shibata ..... H01R 12/716 439/74
8,821,178 B2 * 9/2014 Fukui ..... H01R 4/48 439/342
9,106,006 B2 * 8/2015 Fukui ..... H01R 4/04
2012/0270446 A1 10/2012 Shibata et al.
2015/0162679 A1 * 6/2015 Komoto ..... H01R 12/714 439/670
2015/0171532 A1 * 6/2015 Komoto ..... H01R 12/716 439/670

FOREIGN PATENT DOCUMENTS

JP 2012-226977 A 11/2012

* cited by examiner

*Primary Examiner* — Neil Abrams
(74) *Attorney, Agent, or Firm* — Muncy, Geissler, Olds & Lowe, P.C.

(57) ABSTRACT

A thin connector includes a first connector portion having arrayed first contacts with first contact portions and a second connector portion having arrayed second contacts with second contact portions, each first contact including a first movable portion displaceable in the direction in which the first contacts are arrayed and a second movable portion connected to the first movable portion and displaceable in a direction orthogonal to the direction in which the first contacts are arrayed, the first contact portion being disposed in the second movable portion, the first connector portion and the second connector portion being fitted with each other by sliding relatively in the direction in which the first contacts and the second contacts are arrayed.

12 Claims, 13 Drawing Sheets

THIN CONNECTOR

BACKGROUND OF THE INVENTION

The present invention relates to a thin connector, in particular, to a substrate-to-substrate connector comprising a first connector portion having a flat plate shape and a second connector portion having a flat plate shape superimposed on and fitted with each other in a fitting plane.

As a connector of this type, for example, JP 2012-226977 A discloses a connector as illustrated in FIG. 25. The connector comprises a receptacle 2 mounted on a first substrate 1 and a plug 4 (not shown) mounted on a second substrate 3. In the receptacle 2, a plurality of receptacle contacts 5 having spring properties are formed to be arrayed as illustrated in FIG. 26, and in the plug 4, protruding plug contacts 6 are formed to be arrayed as illustrated in FIG. 27.

Each of the receptacle contacts 5 has a main arm portion 5*a* curved so as to form inside thereof an opening portion S, an auxiliary arm portion 5*b* provided so as to face the main arm portion 5*a*, and a projection portion 5*c* provided in the vicinity of the tip end of the main arm portion 5*a* and the tip end of the auxiliary arm portion 5*b*, as illustrated in FIG. 28. The opening portion S is to receive the plug contact 6.

As illustrated in FIG. 29, upon superimposing the plug 4 on the receptacle 2, the protruding plug contacts 6 of the plug 4 are inserted into the opening portions S of the corresponding receptacle contacts 5, and in this state, the plug 4 mounted on the second substrate 3 is slid in the direction of the arrow C with respect to the receptacle 2 mounted on the first substrate 1 as illustrated in FIG. 30, whereby each of the protruding plug contacts 6 of the plug 4 moves as having its side surface kept in contact with the main arm portion 5*a* over the whole length thereof and is elastically caught among the tip end of the main arm portion 5*a*, the tip end of the auxiliary arm portion 5*b* and the projection portion Sc. Thus, the receptacle 2 and the plug 4 are fitted with each other, and the receptacle contacts 5 and the plug contacts 6 are electrically connected in this manner.

When the receptacle 2 and the plug 4 are fitted with each other, the main arm portion 5*a* of each of the receptacle contacts 5 is pushed by each of the protruding plug contacts 6 of the plug 4 to elastically displace in the direction in which the receptacle contacts 5 are arranged, and, in order to improve reliability of connection between the receptacle contacts 5 and the plug contacts 6, the main arm portion 5*a* of each of the receptacle contacts 5 preferably works as a flexible spring and largely displaces.

On the other hand, in order to ensure the displacement amount of the main arm portion 5*a* of each of the receptacle contacts 5 while preventing the adjacent receptacle contacts 5 from being short-circuited, the receptacle contacts 5 have to be arranged at a large pitch, and it has been difficult to narrow the arrangement pitch.

SUMMARY OF THE INVENTION

The present invention has been made in order to solve the conventional problem described above and is aimed at providing a thin connector capable of narrowing the arrangement pitch and at the same time, improving reliability of connection.

A thin connector according to the present invention comprises a first connector portion having a flat plate shape and a second connector portion having a flat plate shape superimposed on and fitted with the first connector portion in a fitting plane, wherein the first connector portion includes a plurality of first contacts arrayed in a direction, each of the plurality of first contacts having a first contact portion, wherein the second connector portion includes a plurality of second contacts arrayed in a same direction as the direction in which the plurality of first contacts are arrayed, each of the plurality of second contacts having a second contact portion, wherein each of the plurality of first contacts includes a first movable portion having spring properties so as to be displaceable in the direction in which the plurality of first contacts are arrayed and a second movable portion being connected to the first movable portion, having spring properties so as to be displaceable in a direction orthogonal to the direction in which the plurality of first contacts are arrayed, the first contact portion being disposed in the second movable portion, and wherein the first connector portion and the second connector portion are superimposed on each other in the fitting plane and are slid relatively in the direction in which the plurality of first contacts are arrayed so that the second contact portion of each of the plurality of second contacts in the second connector portion comes in contact with the first contact portion of a corresponding first contact among the plurality of first contacts in the first connector portion while the first movable portion and the second movable portion of the first contact in the first connector portion are displaced, whereby the first connector portion and the second connector portion are fitted with each other, and a displacement amount of the first movable portion in the direction in which the plurality of first contacts are arrayed is smaller than a displacement amount of the second movable portion in the direction orthogonal to the direction in which the plurality of first contacts are arrayed.

DETAILED DESCRIPTION OF THE INVENTION

Embodiments of the present invention will be described below based on the appended drawings.

Embodiment 1

Figure 1:
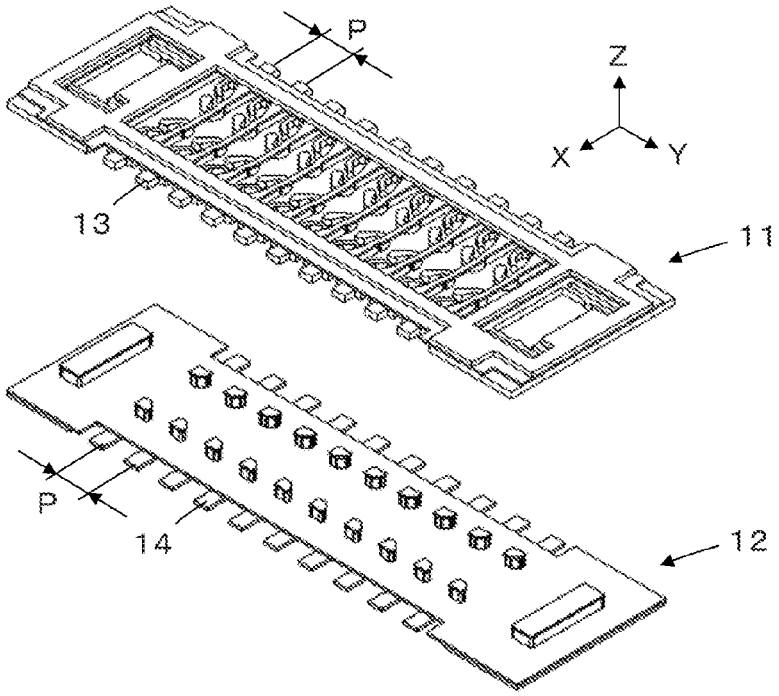
FIG. 1 is a perspective view of a receptacle and a plug of a thin connector, when viewed obliquely from above, according to Embodiment 1 of the present invention.
Figure 2:
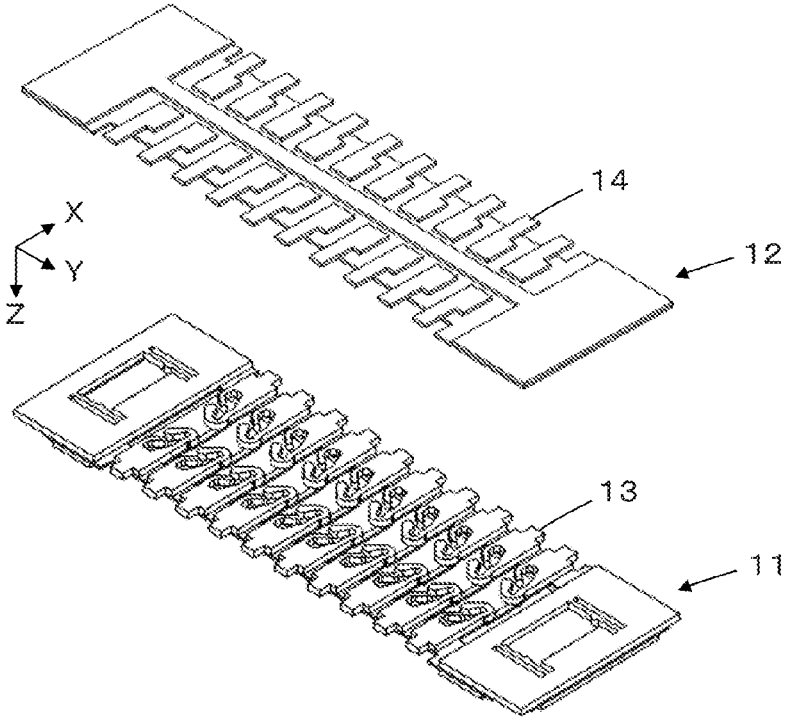
FIG. 2 is a perspective view of the receptacle and the plug of the thin connector, when viewed obliquely from below, according to Embodiment 1.
Figure 3A:
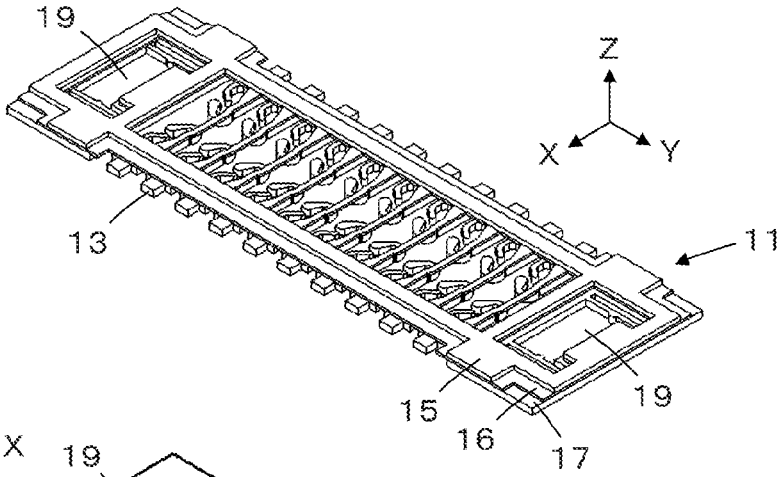
FIGS. 3A-3D are a perspective view when viewed obliquely from above, a perspective view when viewed obliquely from below, a plan view and a bottom view, respectively, illustrating the receptacle used in the thin connector according to Embodiment 1.
Figure 3B:
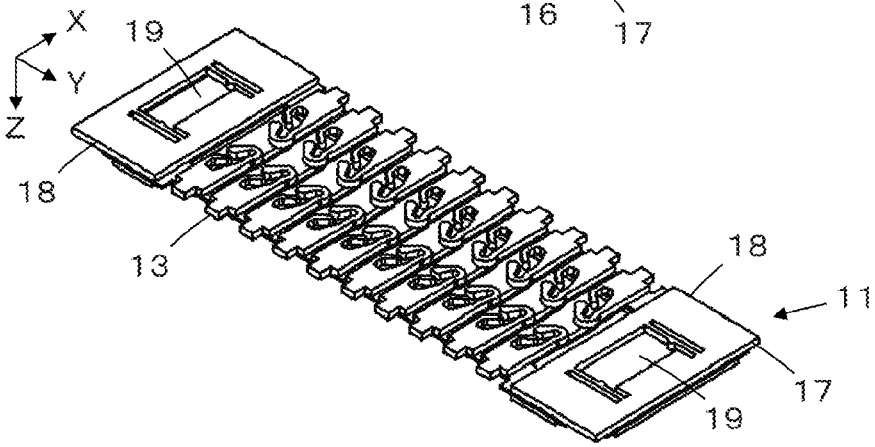
Figure 3C:
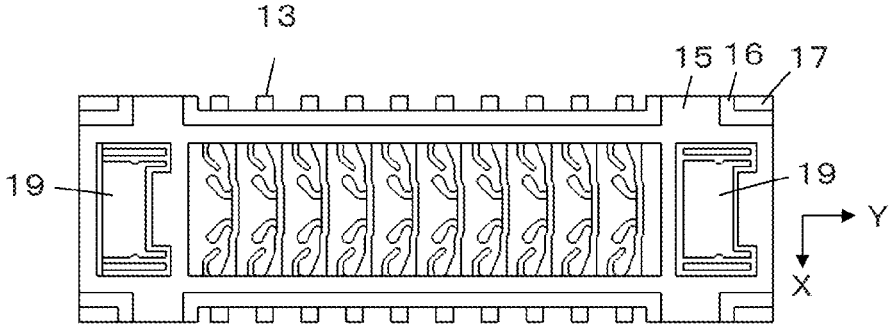
Figure 3D:
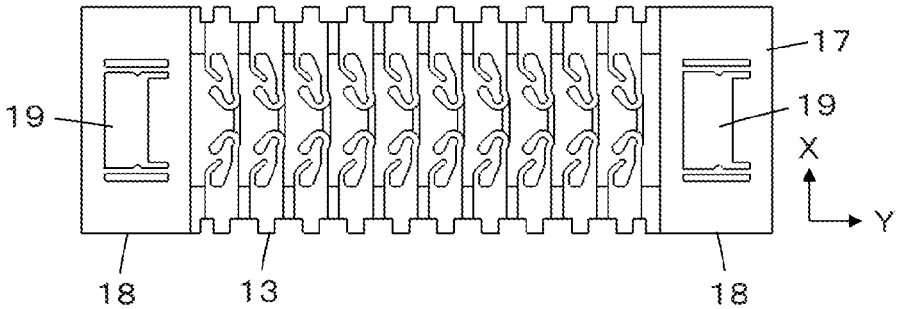

FIGS. 1 and 2 illustrate a configuration of a thin connector according to Embodiment 1 of the present invention. The thin connector comprises a flat plate receptacle (first connector portion) 11 and a flat plate plug (second connector portion) 12, and the receptacle 11 and the plug 12 are superimposed on each other to be fitted together. FIGS. 1 and 2 illustrate the receptacle 11 and the plug 12 that are placed in parallel and apart from each other, and FIG. 1 is a view when viewed obliquely from above while FIG. 2 is a view when viewed obliquely from below.

The receptacle 11 includes a plurality of receptacle contacts (first contacts) 13 arranged in two arrays, while the plug 12 includes a plurality of plug contacts (second contacts) 14 arranged in two arrays. The plurality of receptacle contacts 13 and the plurality of plug contacts 14 are both arranged at the same pitch P.

A plane along which the flat plate receptacle 11 and the flat plate plug 12 extend is assumed to be an XY plane, and a direction in which the plurality of receptacle contacts 13 and the plurality of plug contacts 14 are arranged is assumed to be a Y direction, while the receptacle 11 is assumed to be placed apart from the plug 12 in a Z direction.

As illustrated in FIGS. 3A to 3D, the receptacle 11 has a three-layer structure in which a reinforcing plate 15 made of stainless steel or the like, an insulating sheet 16 made of polyimide or the like, and a conductive material 17 made of copper or the like are sequentially laminated in the −Z direction.

The conductive material 17 is patterned in the XY plane to form the plurality of receptacle contacts 13 arranged in two arrays and form rectangular-shaped end-part conductive members 18 at the end part in a +Y direction and at the other end part in a −Y direction, respectively, such that the end-part conductive members 18 face each other across the receptacle contacts 13.

In addition, the receptacle 11 has opening portions 19 each at the end part in the +Y direction and at the other end part in the −Y direction, the opening portions 19 both penetrating through the laminate body of the receptacle 11 in the Z direction.

Figure 4:
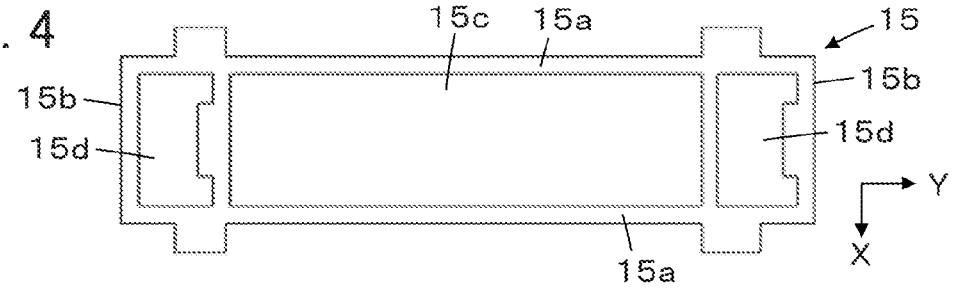
FIG. 4 is a plan view illustrating a reinforcing plate used in the receptacle.

FIG. 4 illustrates the reinforcing plate 15 constituted of a frame-shaped member that has a pair of long side portions 15*a* extending in the Y direction and disposed in parallel so as to be apart from each other in the X direction and a pair of short side portions 15*b* each having a rectangular shape and connecting between the pair of long side portions 15*a* at the end part in the +Y direction and at the other end part in the −Y direction. An opening portion 15*c* is formed at the center of the reinforcing plate 15 and surrounded by the pair of long side portions 15*a* and the short side portions 15*b*. Moreover, each of the pair of short side portions 15*b* has a frame shape inside which an opening portion 15*d* is formed.

Figure 5:
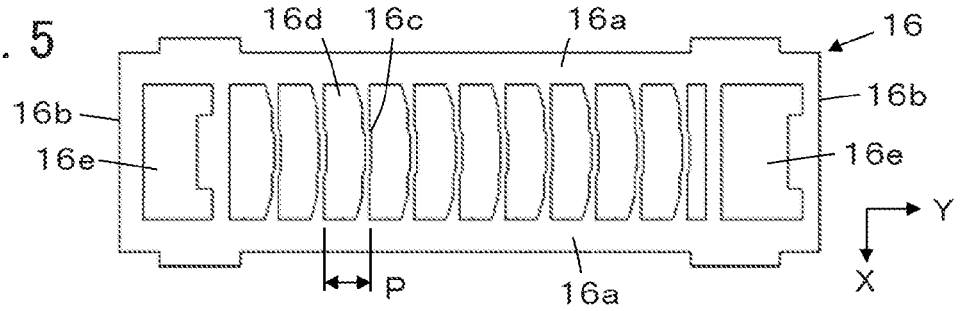
FIG. 5 is a plan view illustrating an insulating sheet used in the receptacle.

FIG. 5 illustrates the insulating sheet 16 constituted of a frame-shaped member corresponding to the reinforcing plate 15. The insulating sheet 16 has a pair of long side portions 16*a* extending in the Y direction and disposed in parallel so as to be apart from each other in the X direction and a pair of short side portions 16*b* each having a rectangular shape and connecting between the pair of long side portions 16*a* at the end part in the +Y direction and at the other end part in the −Y direction. Between the pair of short side portions 16*b*, a plurality of bridge portions 16*c* are arranged in the Y direction at the same arrangement pitch P as that of the plurality of receptacle contacts 13 and extend in the X direction to connect between the pair of long side portions 16*a*, whereby opening portions 16*d* are formed between respective adjacent bridge portions 16*c*. Moreover, each of the pair of short side portions 16*b* has a frame shape inside which an opening portion 16*e* is formed.

Figure 6:
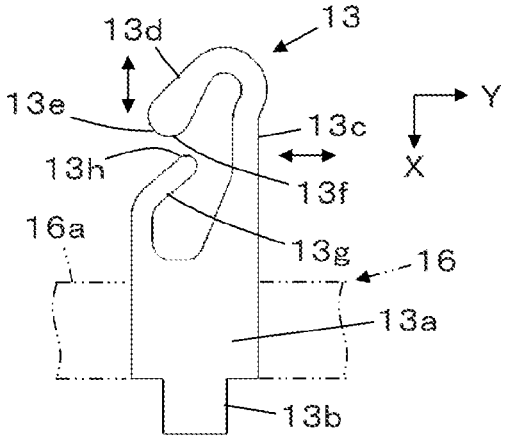
FIG. 6 is a plan view illustrating a receptacle contact.

Each of the receptacle contacts 13 is a flat plate member extending along the XY plane. Among the receptacle contacts 13 arranged in two arrays in the receptacle 11, each of the receptacle contacts 13 arranged on the +X direction side has a holding portion 13*a* to be attached to and held by the corresponding one of the long side portions 16*a* of the insulating sheet 16, while the end portion of the holding portion 13*a* in the +X direction constitutes a receptacle contact drawn-out portion 13*b* that projects from the insulating sheet 16 toward the +X direction, as illustrated in FIG. 6. Meanwhile, the end portion of the holding portion 13*a* in the −X direction is connected to a base part of a first movable portion 13*c* having a cantilever shape and extending in the −X direction, and the tip end of the first movable portion 13*c* is connected to a base part of a second movable portion 13*d*. The second movable portion 13*d* extends from the tip end of the first movable portion 13*c* obliquely in the +X direction and −Y direction, has a tip end 13*e* in a circular arc shape that is rounded at a given curvature, and has a receptacle contact portion (first contact portion) 13*f* in a circular arc shape facing substantially in the +X direction, the receptacle contact portion 13*f* being formed on the extension line of the circular arc of the tip end 13*e* so as to continue from the tip end 13*e*.

In addition, an auxiliary arm portion 13*g* extending in the −X direction and the +Y direction from the end portion of the holding portion 13*a* in the −X direction is disposed so as to face the first movable portion 13*c* and is provided at the tip end thereof with a receptacle auxiliary contact portion 13*h* in a circular arc shape facing substantially in the −X direction.

Among the receptacle contacts 13 arranged in the two arrays in the receptacle 11, receptacle contacts 13 arrayed on the −X direction side are each disposed to be symmetrical to the receptacle contact 13 illustrated in FIG. 6 with respect to the X direction.

Owing to the above-described configuration of the receptacle contact 13, the first movable portion 13*c* has spring properties so as to be displaceable in the Y direction in which the receptacle contacts 13 are arranged, whereas the second movable portion 13*d* has spring properties so as to be displaceable in the X direction orthogonal to the arrangement direction of the receptacle contacts 13.

Figure 7:
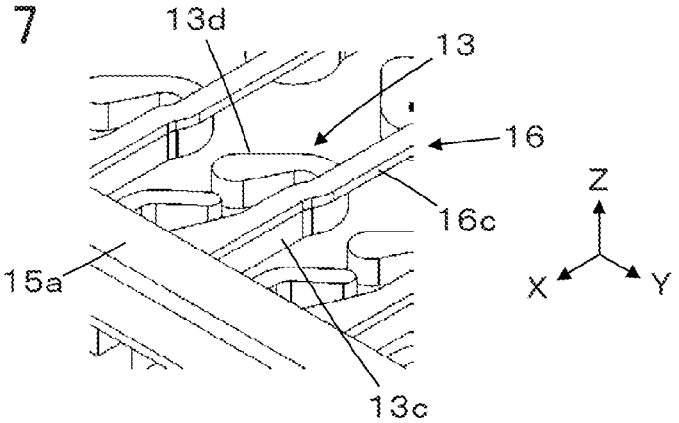
FIG. 7 is an enlarged partial perspective view illustrating a main portion of the receptacle.

As illustrated in FIG. 7, directly above (i.e., on the +Z direction side of) the first movable portion 13*c* of each of the receptacle contacts 13, the corresponding bridge portion 16*c* of the insulating sheet 16 is located and attached to the surface of the first movable portion 13*c*. On the contrary, the bridge portion 16*c* of the insulating sheet 16 is not located directly above the second movable portion 13*d* of each of the receptacle contacts 13.

Figure 8:
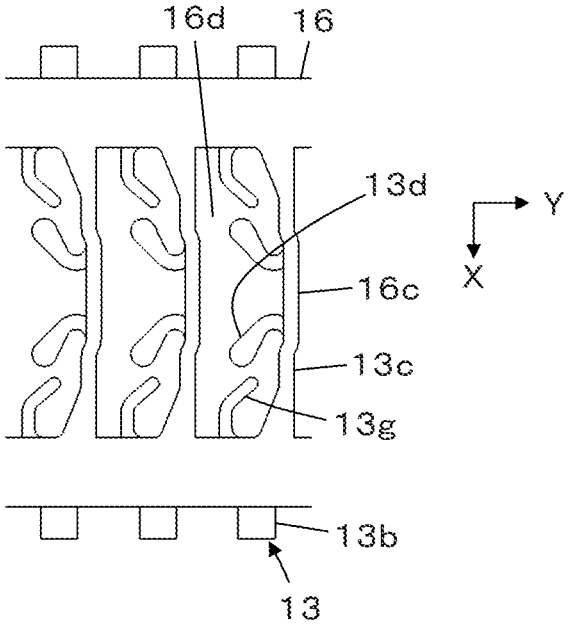
FIG. 8 is a partial plan view illustrating the main portion of the receptacle from which the reinforcing plate has been removed.

As illustrated in FIG. 8, a plurality of bridge portions 16*c* of the insulating sheet 16 are attached onto the first movable portions 13*c* of the corresponding pairs of receptacle contacts 13, i.e., each attached onto the first movable portion 13*c* of one of the receptacle contacts 13 arranged on the +X direction side and the first movable portion 13*c* of the other receptacle contact 13 arranged on the −X direction side in a pair, whereas the second movable portions 13*d* and the auxiliary arm portions 13*g* of the respective receptacle contacts are exposed through the corresponding opening portions 16*d* of the insulating sheet 16.

Since the bridge portions 16*c* of the insulating sheet 16 are attached to, of the first movable portions 13*a* and second movable portions 13*d* of the receptacle contacts 13, the surfaces of only the first movable portions 13*a*, when the first movable portions 13*c* and the second movable portions 13*d* are applied with stress of the same magnitude in the Y direction and the X direction, respectively, the second movable portions 13*d* more readily displace. The bridge portions 16*c* of the insulating sheet 16 suppress displacements of the first movable portions 13*c* and therefore, the first movable portions 13*c* are harder to be displaced than the second movable portions 13*d*.

Figure 9:
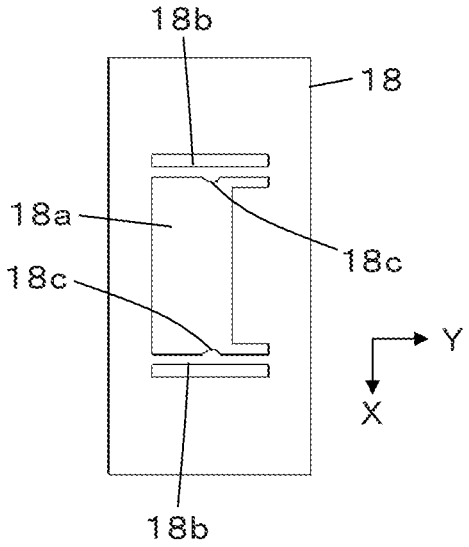
FIG. 9 is a plan view illustrating an end-part conductive member used in the receptacle.

Each of the end-part conductive members 18 of the conductive material 17 has a frame shape inside which a rectangular opening portion 18*a* is formed as illustrated in FIG. 9. The opening portion 18*a* is provided at end portions thereof in the +X direction and in the −X direction with beam members 18*b*, respectively, that extend in the Y direction and are elastically deformable in the X direction. At the center portions of both the beam members 18*b*, projections 18*c* are respectively formed and project toward inside of the opening portion 18*a* so as to oppose to each other. The pair of beam members 18*b* and the pair of projections 18*c* together constitute a first lock portion.

Figure 10:
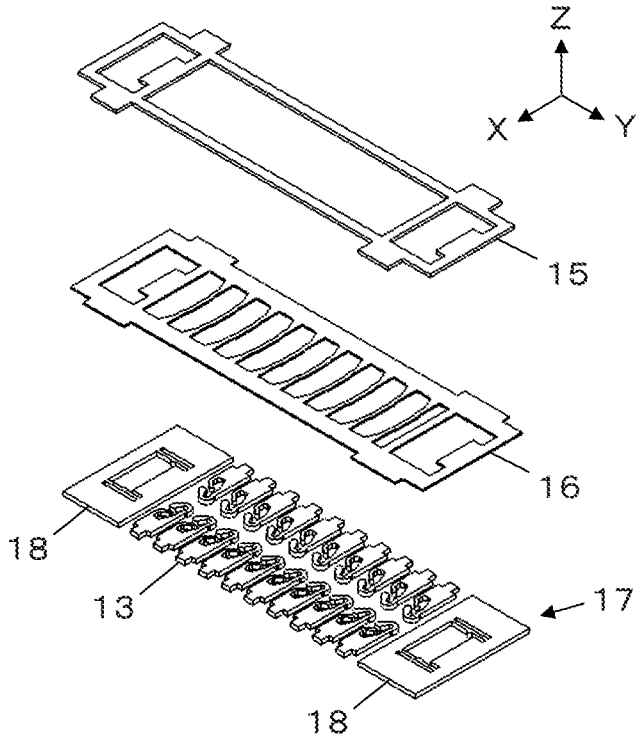
FIG. 10 is an exploded view of the receptacle.
Figure 11A:
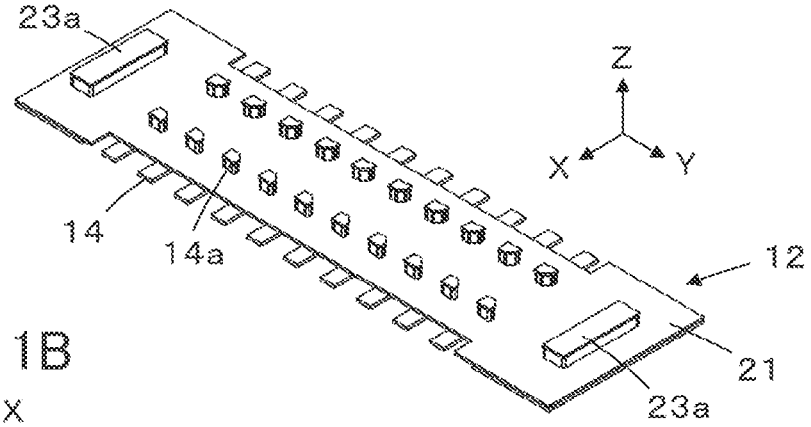
FIGS. 11A-11D are a perspective view when viewed obliquely from above, a perspective view when viewed obliquely from below, a plan view, and a bottom view, respectively, illustrating the plug used in the thin connector according to Embodiment 1.
Figure 11B:
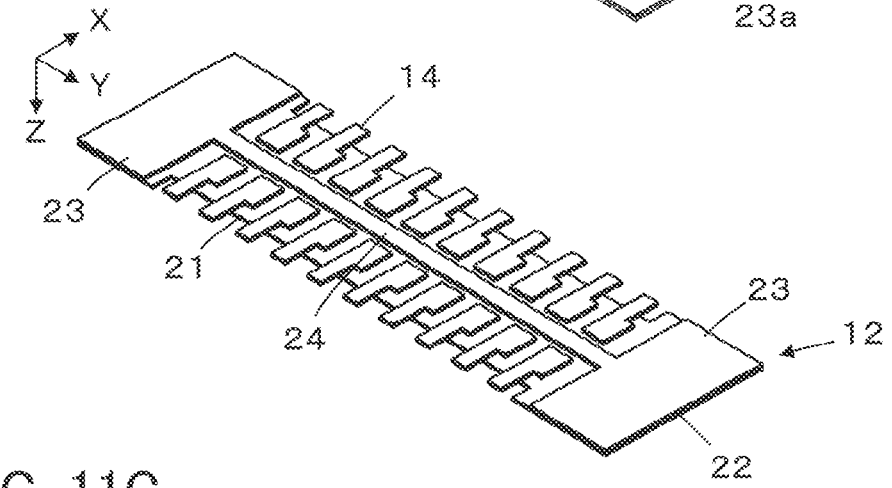
Figure 11C:
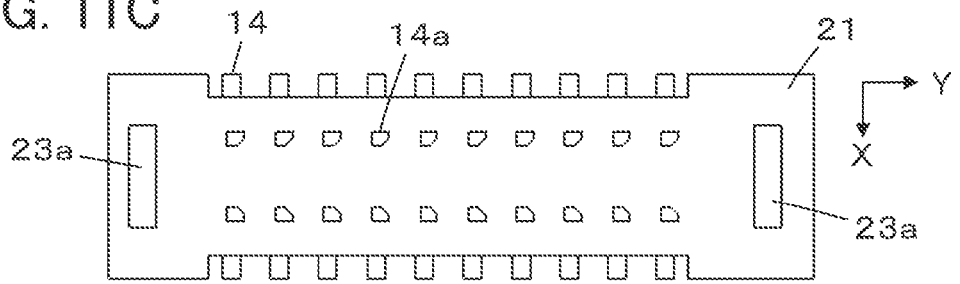
Figure 11D:
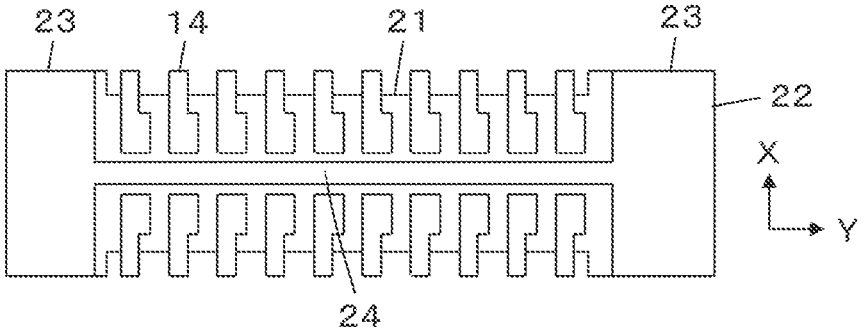

The receptacle 11 can be manufactured through the processes of: etching a polyimide layer, in a laminate having a two-layered structure of the polyimide layer and a copper layer, to form the insulating sheet 16; etching and thereafter nickel/gold plating the copper layer to form the plurality of receptacle contacts 13 and the pair of end-part conductive members 18; and attaching the reinforcing plate 15 made of stainless steel that is formed through the etching process or pressing process onto the insulating sheet 16 using a thermosetting adhesive sheet, as illustrated in FIG. 10, for example.

In the attaching process, a pair of long side portions 15*a* of the reinforcing plate 15 are arranged above and attached to a pair of long side portions 16*a* of the insulating sheet 16. In addition, the opening portions 15*d* in the pair of short side portions 15*b* of the reinforcing plate 15, the opening portions 16*e* in the pair of short side portions 16*b* of the insulating sheet 16 and the opening portions 18*a* in the pair of end-part conductive members 18 of the conductive material 17 are positionally aligned with one another, thereby forming the pair of opening portions 19 of the receptacle 11.

The plurality of receptacle contacts 13 and the pair of end-part conductive members 18 can be formed through additive plating in place of etching process, and in this case, a material composed of a polyimide sheet on the surface of which a copper seed layer is formed can be used.

The plug 12 has a two-layered structure in which a conductive material 22 made of copper or the like is attached to the surface of an insulating sheet 21 made of polyimide or the like on the −Z direction side as illustrated in FIGS. 11A to 11D.

The conductive material 22 is patterned in the XY plane to form the plurality of plug contacts 14 arranged in two arrays on the +X direction side and on the −X direction side and a pair of end-part conductive members 23 each having a rectangular shape at the end part in the +Y direction and at the other end part in the −Y direction, respectively, such that the end-part conductive members 23 face each other across the plurality of plug contacts 14. In addition, a connection member 24 is formed between the plug contacts 14 on the +X direction side and the plug contacts 14 on the −X direction side to extend in the Y direction and connects between the end-part conductive members 23.

Each of the plug contacts 14 has a projection portion 14*a* penetrating the insulating sheet 21 to project in the +Z direction, while each of the pair of end-part conductive members 23 has a projection portion 23*a* having a rectangular shape and penetrating the insulating sheet 21 to project in the +Z direction. The projection portions 14*a* of the plug contacts 14 are formed to positionally correspond to the receptacle contacts 13 of the receptacle 11, respectively.

The projection portions 23*a* of the pair of end-part conductive members 23 constitute second lock portions and are formed to positionally correspond to the pair of opening portions 19 of the receptacle 11, respectively, and each have a length in the X direction slightly shorter than a distance in the X direction between the pair of beam members 18*b* formed in each of the end-part conductive members 18 of the receptacle 11 and also slightly longer than a distance in the X direction between the pair of projections 18*c* and a length in the Y direction of about one half of the length of the corresponding opening portion 19 in the receptacle 11 in the Y direction.

Figure 12A:
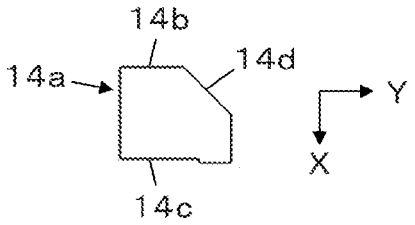
FIGS. 12A and 12B are a plan view and a cross-sectional view each illustrating a projection portion formed on each of plug contacts.

The projection portion 14*a* formed on each of the plug contacts 14 that are arranged on the +X direction side, of the plug contacts 14 arranged in the two arrays in the plug 12, has a substantially pentagonal prism shape the center axis of which extends in the Z direction as illustrated in FIG. 12A. One of the five side surfaces of the projection portion 14*a* that extends along the YZ plane and faces in the −X direction constitutes a plug contact portion (second contact portion) 14*b* in a flat shape, and another of the five side surfaces that extends along the YZ plane and faces in the +X direction, in other words, another side surface on the opposite side of the plug contact portion 14*b*, constitutes a plug auxiliary contact portion 14*c* in a flat shape.

Yet another of the five side surfaces of the projection portion 14*a* that is adjacent to the plug contact portion 14*b* on the +Y direction side faces the −X direction and the +Y direction and constitutes an inclined surface 14*d* inclined with respect to the plug contact portion 14*b*.

Figure 12B:
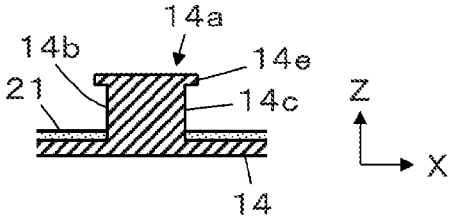

As illustrated in FIG. 12B, the projection portion 14*a* is provided on the upper part thereof with an overhang portion 14*e* overhanging along the XY plane.

The projection portions 14*a* formed on the plug contacts 14 that are arranged on the −X direction side, of the plug contacts 14 arranged in the two arrays in the plug 12, are each disposed to be symmetrical to the projection portion 14*a* illustrated in FIG. 12A with respect to the X direction.

Figure 13:
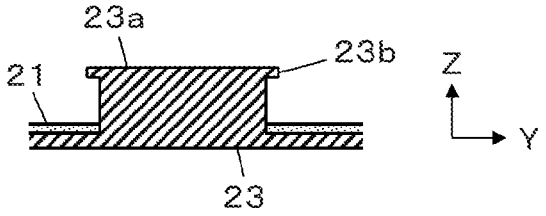
FIG. 13 is a cross-sectional view illustrating a projection portion formed on an end-part conductive member in the plug.

In addition, as illustrated in FIG. 13, the projection portion 23*a* of each of the end-part conductive members 23 is provided on the upper part thereof with an overhang portion 23*b* overhanging along the XY plane.

Figure 14:
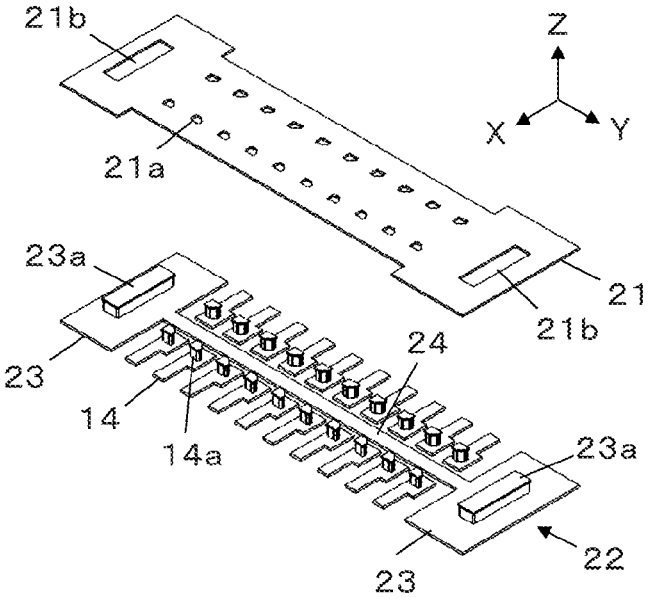
FIG. 14 is an exploded view of the plug.

The plug 12 in a two-layered structure having a polyimide layer and a copper layer can be manufactured through the processes of: etching the polyimide layer until the surface of the copper layer is exposed to form a plurality of holes 21*a* respectively corresponding to the projection portions 14*a* of the plurality of plug contacts 14 and a pair of rectangular holes 21*b* respectively corresponding to the projection portions 23*a* in the pair of end-part conductive members 23; etching the copper layer to form the plug contacts 14, the pair of end-part conductive members 23 and the connection member 24; performing additive plating on the copper layer to form the projection portions 14*a* of the plug contacts 14 and the projection portions 23*a* in the pair of end-part conductive members 23; and thereafter performing nickel/gold plating on the conductive material 22 as illustrated in FIG. 14, for example.

Alternatively, the plug contacts 14, the pair of end-part conductive members 23 and the connection member 24 can be formed using a material in which a copper seed layer is formed on the surface of the polyimide sheet and performing additive plating, in place of etching.

Next, the behavior of the thin connector according to Embodiment 1 in fitting will be described below. As illustrated in FIG. 1, the receptacle 11 is positioned above (i.e., on the +Z direction side) the plug 12 and is lowered to be superimposed on the plug 12. In this process, the lower surface (surface facing in the −Z direction) of the conductive member 17 of the receptacle 11 and the upper surface (surface facing in the +Z direction) of the insulating sheet 21 of the plug 12 together form a fitting plane of the thin connector.

Figure 15:
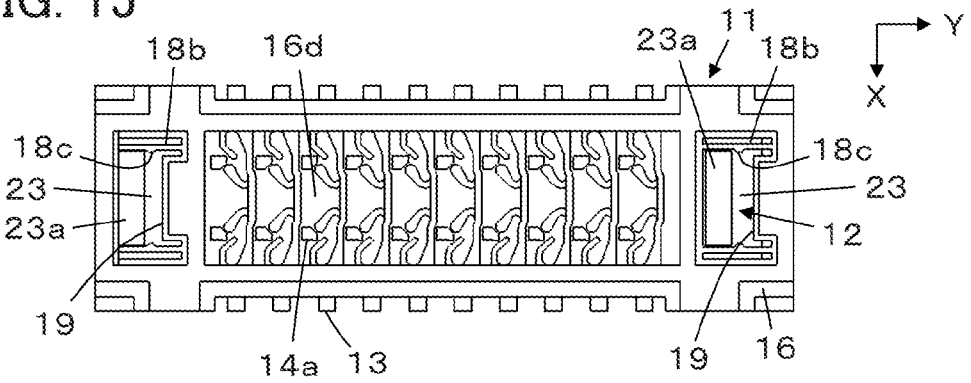
FIG. 15 is a plan view illustrating the thin connector according to Embodiment 1 before fitting.

In addition, as illustrated in FIG. 15, the receptacle 11 and the plug 12 are aligned such that the projection portions 14*a* of the plurality of plug contacts 14 of the plug 12 respectively face the corresponding receptacle contacts 13 in the corresponding opening portions 16*d* of the insulating sheet 16 of the receptacle 11, while the projection portions 23*a* of the pair of end-part conductive members 23 of the plug 12 are inserted into the corresponding opening portions 19 of the receptacle 11 so as to be positioned at the end portions on the −Y direction side in the opening portions 19.

Being positioned at the end portion on the −Y direction side in the corresponding opening portion 19 of the receptacle 11, the projection portion 23*a* of each of the end-part conductive members 23 of the plug 12 is located between the pair of beam members 18*b* in the opening portion 19 so as not to be in contact with the pair of projections 18*c* formed at each of the end-part conductive members 18 of the receptacle 11. As described above, each of the projection portions 23*a* has a length in the X direction slightly shorter than the distance between the pair of beam members 18*b* of the receptacle 11 in the X direction. Accordingly, each of the projection portions 23*a* is not positionally limited by the pair of beam members 18*a*, and the plug 12 is slidable in the +Y direction along the fitting plane.

Figure 16A:
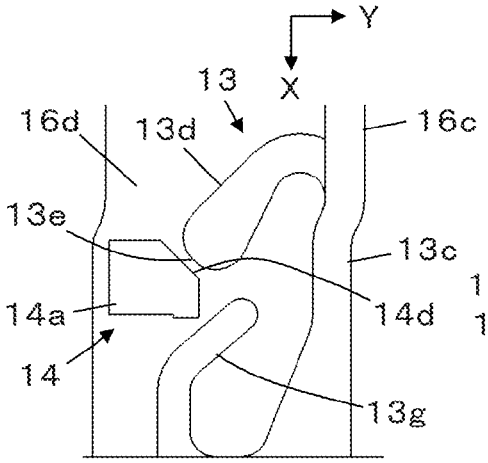
FIGS. 16A and 16B are a partial plan view illustrating the positional relation between the receptacle contact and the plug contact before fitting and a partial plan view illustrating the positional relation between the receptacle contact and the plug contact at the start of fitting, respectively.

In this state, as illustrated in FIG. 16A, the projection portion 14*a* of each of the plug contacts 14 of the plug 12 faces but is apart from the corresponding receptacle contact 13, and the plug contact 14 is therefore electrically insulated from the receptacle contact 13. In the projection portion 14*a* of each of the plug contacts 14, the inclined surface 14*d* facing in the −X direction and the +Y direction is opposed to the tip end 13*e* of the second movable portion 13*d* of the corresponding receptacle contact 13.

Figure 16B:
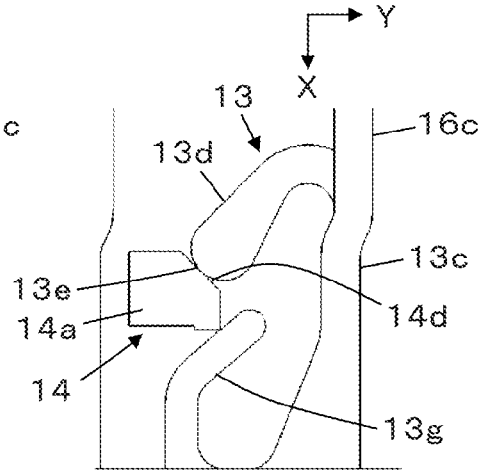

If the plug 12 in this state is slid in the +Y direction relatively to the receptacle 11, the inclined surface 14*d* of the projection portion 14*a* of each of the plug contacts 14 comes in contact with the rounded tip end 13*e* of the second movable portion 13*d* of the corresponding receptacle contact 13 as illustrated in FIG. 16B and thereafter moves in the +Y direction while pushing the tip end 13*e* in the −X direction and the +Y direction. As a result, the second movable portion 13*d* of the receptacle contact 13 displaces in the −X direction, whereas the first movable portion 13*c* displaces in the +Y direction.

Figure 17:
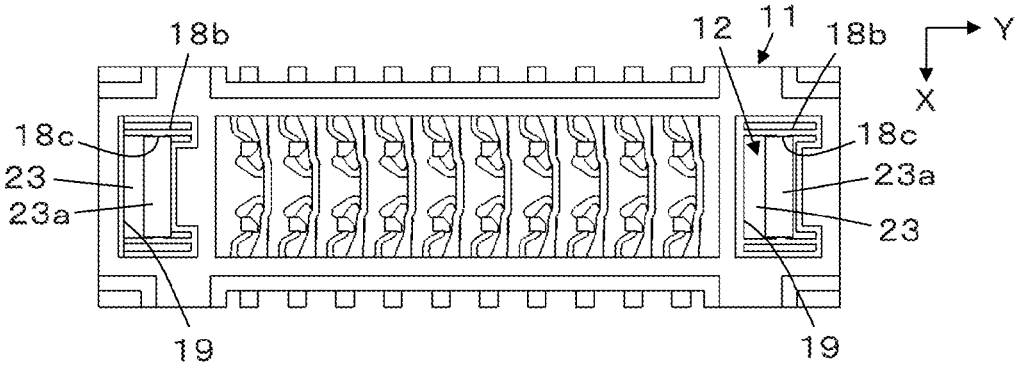
FIG. 17 is a plan view illustrating the thin connector according to Embodiment 1 at the time of completion of fitting.
Figure 18:
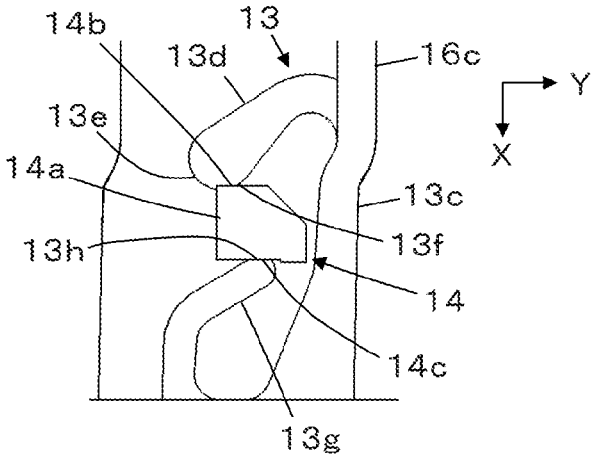
FIG. 18 is a partial plan view illustrating the positional relation between the receptacle contact and the plug contact at the time of completion of fitting.

When the plug 12 is slid in the +Y direction relatively to the receptacle 11 until the projection portions 23*a* of the pair of end-part conductive members 23 of the plug 12 respectively come to the end portions on the +Y direction side in the corresponding opening portions 19 of the receptacle 11 as illustrated in FIG. 17, the projection portion 14*a* of each of the plug contacts 14 advances to the position to be caught between the receptacle contact portion 13*f* of the second movable portion 13*d* and the receptacle auxiliary contact portion 13*h* of the auxiliary arm portion 13*g* of the corresponding receptacle contact 13 as illustrated in FIG. 18, whereby the plug contact portion 14*b* constituted of the side surface of the projection portion 14*a* of the plug contact 14 that face in the −X direction and the receptacle contact portion 13*f* of the second movable portion 13*d* of the receptacle contact 13 that faces in the +X direction are brought into contact with each other with a predetermined contact force owing to the spring properties of the second movable portion 13*d* of the receptacle contact 13 that has displaced in the −X direction and are electrically connected with each other. The receptacle 11 and the plug 12 are fitted with each other in this manner.

At this time, the receptacle contact portion 13*f* and the plug contact portion 14*b* are electrically connected while dimension tolerances of the receptacle contact 13 and the plug contact 14 are absorbed since the first movable portion 13*c* of the receptacle contact 13 is formed to be displaceable in the Y direction. In the meantime, the bridge portion 16*c* of the insulating sheet 16 is attached on, of the first movable portion 13*c* and the second movable portion 13*d* of the receptacle contact 13, only the first movable portion 13*c*, and therefore, the second movable portion 13*d* more readily displaces, whereas the first movable portion 13*c* is constituted to be harder to displace than the second movable portion 13*d*.

Figure 19:
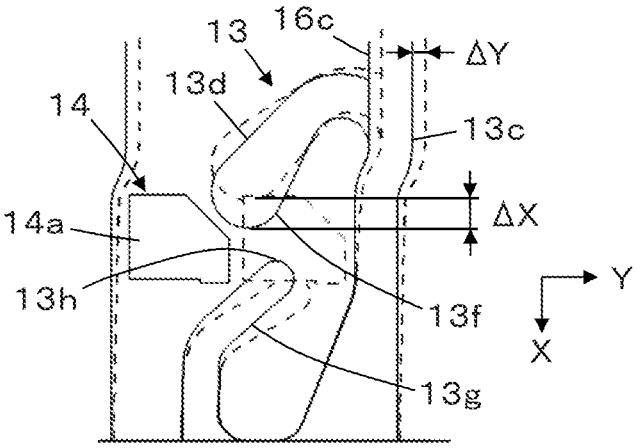
FIG. 19 is a partial plan view illustrating the positional relation between the receptacle contact and the plug contact before and after fitting.

Accordingly, as illustrated in FIG. 19, the maximum displacement amount ΔY of the first movable portion 13*c* that displaces in the Y direction along with the relative movement of the projection portion 14*a* of the plug contact 14 is smaller than the displacement amount ΔX of the second movable portion 13*d* in the X direction. In other words, while the second movable portion 13*d* of the receptacle contact 13 displaces largely in the X direction and generates a predetermined contact force between the receptacle contact portion 13*f* and the plug contact portion 14*b*, the displacement amount ΔY of the first movable portion 13*c* in the Y direction is small, thereby enabling to narrow the arrangement pitch of the receptacle contacts 13 and improve reliability of the electrical connection at the same time.

Moreover, when the receptacle 11 and the plug 12 are fitted with each other, as illustrated in FIG. 18, the receptacle auxiliary contact portion 13*h* of the auxiliary arm portion 13*g* of the receptacle contact 13 is brought into contact with the plug auxiliary contact portion 14*c* constituted of the side surface of the projection portion 14*a* of the plug contact 14 that faces in the +X direction, so that electrical connection is established also between the auxiliary arm portion 13*g* and the projection portion 14*a* of the plug contact 14.

When the projection portions 23*a* of the pair of end-part conductive members 23 of the plug 12 are respectively positioned at the end portions on the +Y direction side in the corresponding opening portions 19 of the receptacle 11 as illustrated in FIG. 17, the projection portions 23*a* are caught in the X direction in the opening portions 19 by the pairs of projections 18*c* formed in the end-part conductive members 18, respectively, whereby the pairs of beam members 18*b* elastically deform to press and hold the projection portions 23*a* of the plug 12. Accordingly, the receptacle 11 and the plug 12 are locked in the fitted state, whereby the electrical connection between the receptacle contact portion 13*f* and the plug contact portion 14*b* and the electrical connection between the receptacle auxiliary contact portion 13*h* and the plug auxiliary contact portion 14*c* can be maintained.

Since the projection portion 23*a* of each of the end-part conductive members 23 of the plug 12 is provided on its upper part with the overhang portion 23*b* overhanging along the XY plane as illustrated in FIG. 13, when the projection portion 23*a* of the plug 12 is positioned at the end portion on the +Y direction side in the corresponding opening portion 19 of the receptacle 11, the projections 18*c* of the receptacle 11 are positioned under (i.e., on the −Z direction side of) the overhang portion 23*b* of each of the end-part conductive members 23 of the plug 12 and thereby prevented from coming off the end-part conductive member 23 of the plug 12 in the Z direction.

Figure 20:
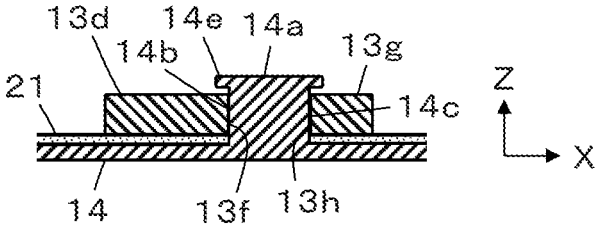
FIG. 20 is a cross-sectional view illustrating the projection portion on the plug contact and the receptacle contact at the time of completion of fitting.

Since the projection portion 14*a* of each of the plug contacts 14 is provided on its upper part with the overhang portion 14*e* overhanging along the XY plane, when the corresponding receptacle contact portion 13*f* is brought into contact with the plug contact portion 14*b*, the receptacle contact portion 13*f* constituted of the tip end of the second movable portion 13*d* is positioned under (i.e., on the −Z direction side of) the overhang portion 14*e* of the projection portion 14*a* as illustrated in FIG. 20 and thereby prevented from coming off the plug contact portion 14*b* in the Z direction. Similarly, the receptacle auxiliary contact portion 13*h* constituted of the tip end of the auxiliary arm portion 13*g* is positioned under (i.e., on the −Z direction side of) the overhang portion 14*e* of the projection portion 14*a* and thereby prevented from coming off the plug auxiliary contact portion 14*c* in the Z direction.

Embodiment 2

In Embodiment 1 described above, the bridge portion 16*c* of the insulating sheet 16 is attached on, of the first movable portion 13*c* and the second movable portion 13*d* of each of the receptacle contacts 13, only the first movable portion 13*c*, and the receptacle contact 13 is constituted such that the first movable portion 13*c* more readily displaces than the second movable portion 13*d*, whereby the displacement amount ΔY of the first movable portion 13*c* in the Y direction is smaller than the displacement amount ΔX of the second movable portion 13*d* in the X direction in the receptacle contact 13 before and after fitting of the receptacle 11 with the plug 12. However, the invention is not limited thereto.

Figure 21:
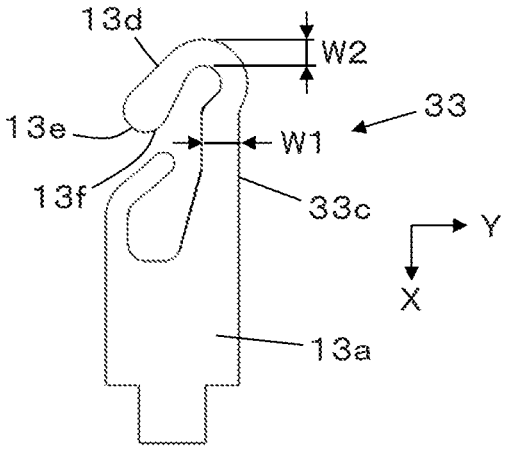
FIG. 21 is a plan view illustrating a receptacle contact used in a receptacle of a thin connector according to Embodiment 2.

FIG. 21 illustrates a receptacle contact 33 used in a receptacle of a thin connector according to Embodiment 2. The receptacle contact 33 is same as the receptacle contact 13 in Embodiment 1 as illustrated in FIG. 6 except that a first movable portion 33*c* having a wider width is used in place of the first movable portion 13*c* of the receptacle contact 13 in Embodiment 1.

The first movable portion 33*c* has a width W1 that is wider than a width W2 of the second movable portion 13*d*, and the first movable portion 33*c* is thus configured to be harder to displace than the second movable portion 13*d*.

With the use of the receptacle contact 33, the displacement amount ΔY of the first movable portion 33*c* in the Y direction can be smaller than the displacement amount ΔX of the second movable portion 13*d* in the X direction before and after fitting of the receptacle 11 with the plug 12, even when the bridge portion 16*c* of the insulating sheet 16 is not attached onto the first movable portion 33*c*.

Therefore, similarly to Embodiment 1, the arrangement pitch of the receptacle contacts can be narrowed while reliability of the electrical connection can be improved.

Embodiment 3

Figure 22A:
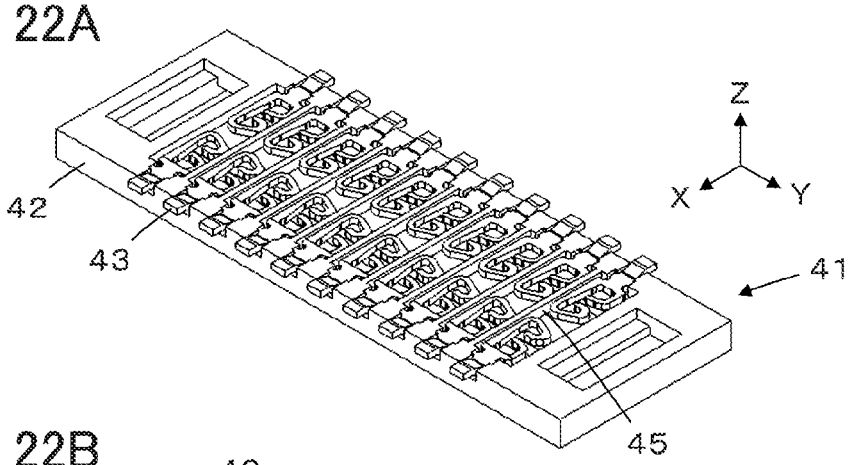
FIGS. 22A and 22B are a perspective view when viewed obliquely from above and a plan view each illustrating a receptacle of a thin connector according to Embodiment 3.
Figure 22B:
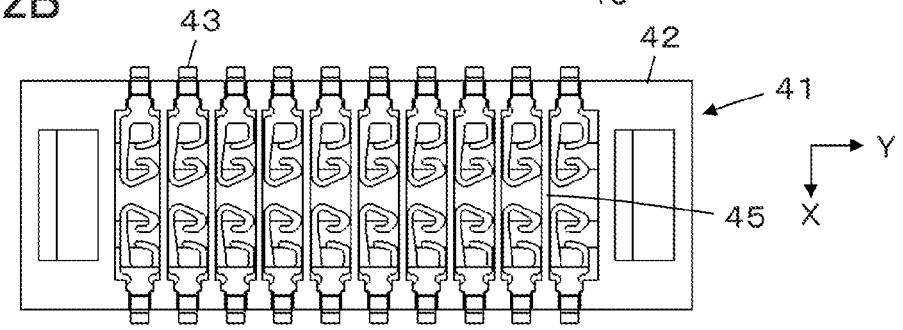

FIGS. 22A and 22B illustrate a receptacle 41 of a thin connector according to Embodiment 3.

The receptacle 41 has a flat plate shape and includes a receptacle insulator 42 having a frame shape and a plurality of receptacle contacts (first contacts) 43 arranged in two arrays and held by the receptacle insulator 42. The receptacle insulator 42 has a plurality of displacement restriction portions 45 each having a beam shape and extending in the X direction so as to separate adjacent receptacle contacts 45 arranged in the Y direction.

In this embodiment, a plane along which the flat plate receptacle 41 extends is assumed to be an XY plane, and a direction in which the plurality of receptacle contacts 43 are arranged is assumed to be a Y direction, while a direction perpendicular to the XY plane is assumed to be a Z direction.

Figure 23A:
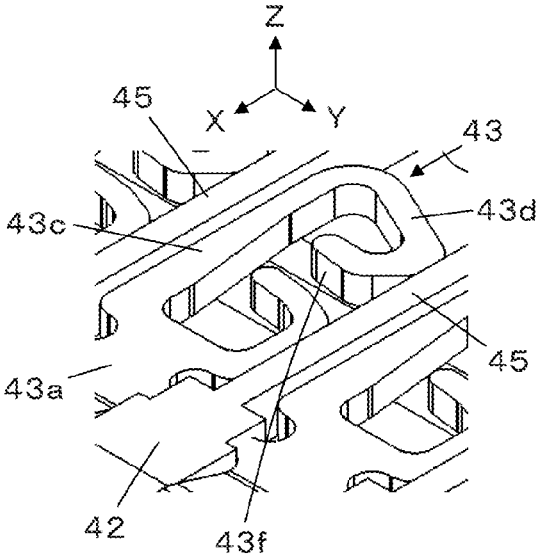
FIGS. 23A and 23B are a partial perspective view and a partial plan view each illustrating a vicinity of a receptacle contact in the receptacle of the thin connector according to Embodiment 3.

Similarly to the receptacle contact 13 used in Embodiment 1, as illustrated in FIG. 23A, each of the receptacle contacts 43 has a holding portion 43*a* to be held by the receptacle insulator 42, a first movable portion 43*c* having a cantilever shape and extending from the holding portion 43*a* in the −X direction, and a second movable portion 43*d* connected to the tip end of the first movable portion 43*c*, while the tip end of the second movable portion 43*d* constitutes a receptacle contact portion (first contact portion) 43*f* facing substantially in the +X direction.

The first movable portion 43*c* has spring properties to be displaceable in the Y direction in which the receptacle contacts 43 are arranged, whereas the second movable portion 43*d* has spring properties to be displaceable mainly in the X direction orthogonal to the direction in which the receptacle contacts 43 are arranged.

Figure 23B:
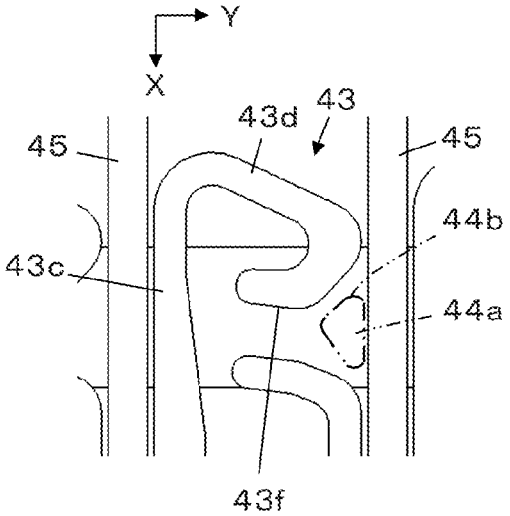

As illustrated in FIG. 23B, when a projection portion 44*a* of each of plug contacts of a plug which is not shown is positioned in the vicinity of the corresponding receptacle contact 43 of the receptacle 41, and the projection portion 44*a* is moved in the −Y direction along with the sliding operation of the plug with respect to the receptacle 41, the second movable portion 43*d* of the receptacle contact 43 is pushed by the projection portion 44*a* so as to displace in the −X direction, whereby the first movable portion 43*c* displaces in the −Y direction. When the receptacle 41 and the plug are fitted with each other, the plug contact portion 44*b* constituted of a side surface of the projection portion 44*a* and the receptacle contact portion 43*f* of the second movable portion 43*d* of each of the receptacle contacts 43 are brought into contact with each other with a predetermined contact force and thereby electrically connected.

At this time, since the receptacle insulator 42 has the displacement restriction portions 45 each having a beam shape and extending in the X direction so as to separate adjacent receptacle contacts 43 arranged in the Y direction, the maximum displacement amount of the first movable portion 43*c* in the −Y direction is restricted by each of the displacement restriction portions 45 such that the first movable portion 43*c* cannot further displace in the −Y direction when coming in contact with the displacement restriction portion 45. On the other hand, there is no displacement restriction member for restricting the displacement of the second movable portion 43*d* in the X direction. Therefore, a displacement amount of the first movable portion 43*c* in the Y direction is smaller than a displacement amount of the second movable portion 43*d* in the X direction. As a result, the arrangement pitch of the receptacle contacts can be narrowed while reliability of the electrical connection can be improved.

Figure 24:
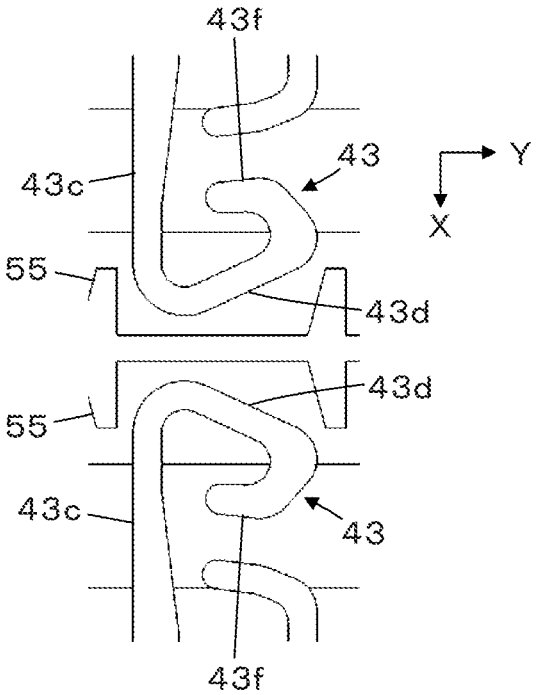
FIG. 24 is a partial plan view illustrating a vicinity of a receptacle contact in a receptacle of a thin connector according to a variation of Embodiment 3.
Figure 25:
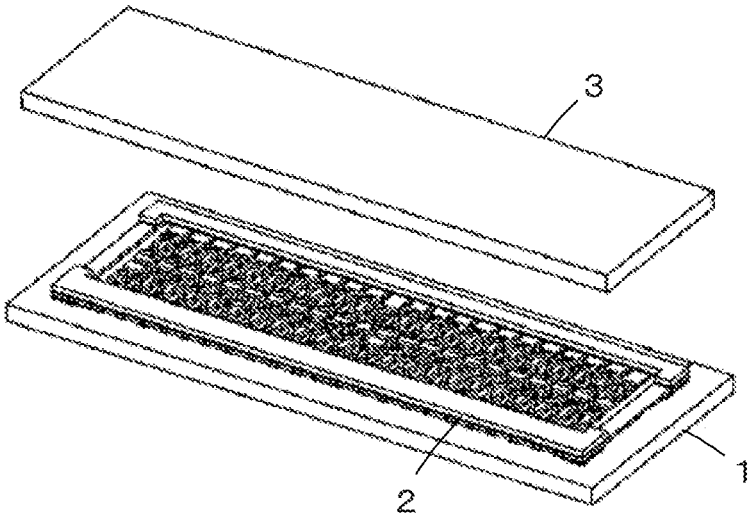
FIG. 25 is a perspective view illustrating a configuration of a conventional connector.
Figure 26:
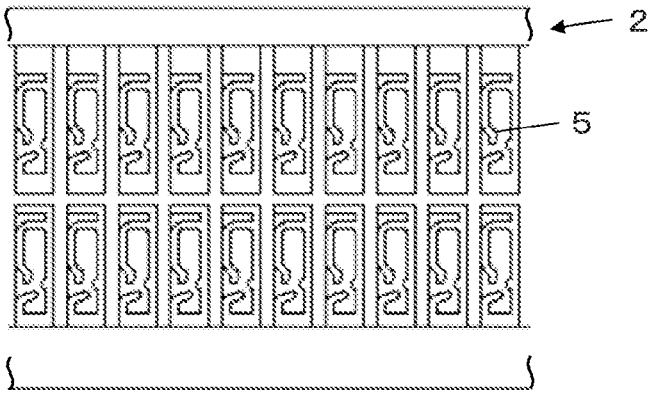
FIG. 26 is a partial plan view illustrating a receptacle used in the conventional connector.
Figure 27:
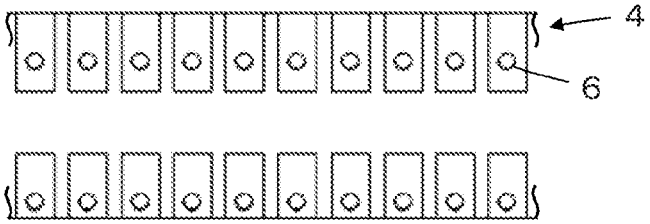
FIG. 27 is a partial plan view illustrating a plug used in the conventional connector.
Figure 28:
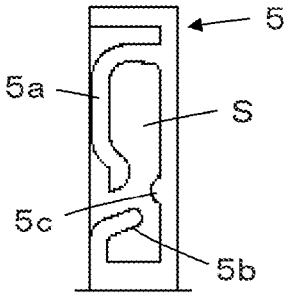
FIG. 28 is an enlarged plan view illustrating a receptacle contact used in the conventional connector.
Figure 29:
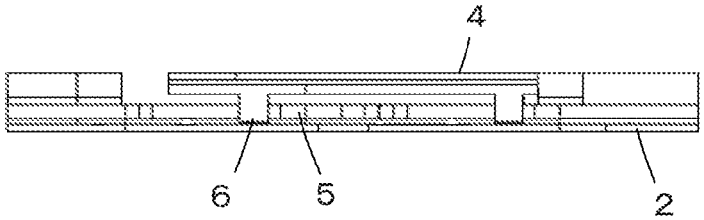
FIG. 29 is a side view illustrating the conventional connector before fitting.
Figure 30:
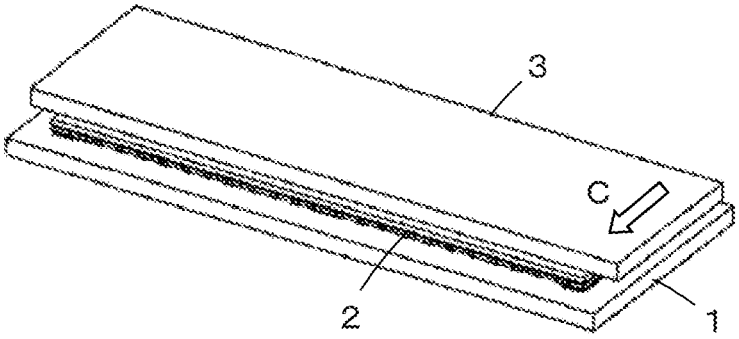
FIG. 30 is a perspective view illustrating fitting behavior in the conventional connector.

In place of the displacement restriction portions 45 each having a beam shape and extending in the X direction so as to separate adjacent receptacle contacts 43 arranged in the Y direction, as illustrated in FIG. 24, a displacement restriction portion 55 in a projection shape may be provided in the vicinity and on the Y direction side of the tip end of the first movable portion 43*c* of each of the receptacle contacts 43.

When the first movable portion 43*c* of each of the receptacle contacts 43 that displaces in the −Y direction is brought into contact with the displacement restriction portion 55 at the time of fitting of the connector, the first movable portion 43*c* cannot further displace in the −Y direction, whereby the maximum displacement amount of the first movable portion 43*c* is restricted by the displacement restriction portion 55.

Also with this configuration, the displacement amount of the first movable portion 43*c* in the Y direction can be smaller than the displacement amount of the second movable portion 43*d* in the X direction, and therefore the arrangement pitch of the receptacle contacts can be narrowed while reliability of connection can be improved.

In Embodiments 1 to 3, the receptacle 11 or 41 includes the plurality of receptacle contacts 13, 33 or 43 arranged in two arrays, while the plug 12 includes the plurality of plug contacts 14 arranged in two arrays. However, the plurality of receptacle contacts and the plurality of plug contacts can be arranged in a single array or in three or more arrays.

What is claimed is:

1. A thin connector comprising:

a first connector portion having a flat plate shape; and a second connector portion having a flat plate shape superimposed on and fitted with the first connector portion in a fitting plane, wherein the first connector portion includes a plurality of first contacts arrayed in a direction, each of the plurality of first contacts having a first contact portion, wherein the second connector portion includes a plurality of second contacts arrayed in a same direction as the direction in which the plurality of first contacts are arrayed, each of the plurality of second contacts having a second contact portion, wherein each of the plurality of first contacts includes a first movable portion having spring properties so as to be displaceable in the direction in which the plurality of first contacts are arrayed and a second movable portion being connected to the first movable portion, having spring properties so as to be displaceable in a direction orthogonal to the direction in which the plurality of first contacts are arrayed, the first contact portion being disposed in the second movable portion, and wherein the first connector portion and the second connector portion are superimposed on each other in the fitting plane and are slid relatively in the direction in which the plurality of first contacts are arrayed so that the second contact portion of each of the plurality of second contacts in the second connector portion comes in contact with the first contact portion of a corresponding first contact among the plurality of first contacts in the first connector portion while the first movable portion and the second movable portion of the first contact in the first connector portion are displaced, whereby the first connector portion and the second connector portion are fitted with each other, and a displacement amount of the first movable portion in the direction in which the plurality of first contacts are arrayed is smaller than a displacement amount of the second movable portion in the direction orthogonal to the direction in which the plurality of first contacts are arrayed.

2. The thin connector according to claim 1, wherein the first movable portion of each of the plurality of first contacts has a cantilever shape extending in the direction orthogonal to the direction in which the plurality of first contacts are arrayed, and the second movable portion is connected to an end portion of the first movable portion.

3. The thin connector according to claim 1, wherein each of the first connector portion and the second connector portion has an insulating sheet and a conductive material attached to a surface of the insulating sheet, and the plurality of first contacts and the plurality of second contacts are formed at the conductive material.

4. The thin connector according to claim 3, wherein the insulating sheet is attached on only the first movable portion, of the first movable portion and the second movable portion of each of the plurality of first contacts.

5. The thin connector according to claim 3, wherein the insulating sheet is made of polyimide.

6. The thin connector according to claim 3, wherein the first connector portion includes a reinforcing plate attached to another surface of the insulating sheet on an opposite side to the conductive material.

7. The thin connector according to claim 1, wherein the first movable portion of each of the plurality of first contacts has a width wider than a width of the second movable portion.

8. The thin connector according to claim 1, wherein each of the plurality of second contacts has a projection portion projecting in a direction perpendicular to the fitting plane, and the second contact portion is constituted of a side surface of the projection portion.

9. The thin connector according to claim 8, wherein the projection portion of each of the plurality of second contacts has on an upper part thereof an overhang portion overhanging along the fitting plane.

10. The thin connector according to claim 8, wherein the projection portion of each of the plurality of second contacts is formed by additive plating.

11. The thin connector according to claim 1, wherein the first connector portion and the second connector portion have first lock portions and second lock portions, respectively, disposed at both end portions of the first connector portion and both end portions of the second connector portion in the direction in which the plurality of first contacts and the plurality of second contacts are arrayed, the first lock portions and the second lock portions maintaining a state of fitting between the first connector portion and the second connector portion.

12. The thin connector according to claim 1, wherein the first connector portion includes a plurality of displacement restriction portions each of which is formed between adjacent first contacts among the plurality of first contacts and restricts a maximum displacement amount of the first movable portion of each of the plurality of first contacts in the direction in which the plurality of first contacts are arrayed.

* * * * *